US008262506B2

(12) United States Patent
Watson et al.

(10) Patent No.: US 8,262,506 B2
(45) **Date of Patent: *Sep. 11, 2012**

(54) GOLF CLUB HEAD WITH COMPOSITE WEIGHT PORT

(75) Inventors: William C. Watson, Temecula, CA (US); Martin Peralta, Oceanside, CA (US); Patrick Dawson, San Diego, CA (US); Irina Ivanova, Carlsbad, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/448,067

(22) Filed: Apr. 16, 2012

(65) Prior Publication Data

US 2012/0202616 A1 Aug. 9, 2012

Related U.S. Application Data

(63) Continuation of application No. 13/364,089, filed on Feb. 1, 2012, now Pat. No. 8,197,358, which is a continuation of application No. 13/248,855, filed on Sep. 29, 2011, which is a continuation-in-part of application No. 12/940,371, filed on Nov. 5, 2010.

(60) Provisional application No. 61/388,124, filed on Sep. 30, 2010, provisional application No. 61/286,971, filed on Dec. 16, 2009.

(51) Int. Cl.
*A63B 53/04* (2006.01)
*A63B 53/06* (2006.01)

(52) U.S. Cl. ..... 473/334; 473/335; 473/338; 473/345; 473/349

(58) Field of Classification Search ..... 473/324–350, 473/287–292, 256
See application file for complete search history.

(56) References Cited

U.S. PATENT DOCUMENTS

| | | | | | |
|---|---|---|---|---|---|
| 2,056,335 | A * | 10/1936 | Wettlaufer | ..... | 473/245 |
| 3,556,533 | A * | 1/1971 | Hollis | ..... | 473/338 |
| 3,582,081 | A * | 6/1971 | Caplan | ..... | 473/338 |
| 3,692,306 | A * | 9/1972 | Glover | ..... | 473/306 |
| 4,085,934 | A * | 4/1978 | Churchward | ..... | 473/338 |
| 4,795,159 | A * | 1/1989 | Nagamoto | ..... | 473/338 |
| 4,869,507 | A * | 9/1989 | Sahm | ..... | 473/337 |
| 5,050,879 | A * | 9/1991 | Sun et al. | ..... | 473/338 |
| 5,447,309 | A * | 9/1995 | Vincent | ..... | 473/345 |
| 5,871,407 | A * | 2/1999 | Tseng | ..... | 473/328 |
| 5,947,840 | A * | 9/1999 | Ryan | ..... | 473/335 |
| 6,089,994 | A * | 7/2000 | Sun | ..... | 473/338 |
| 6,409,612 | B1 * | 6/2002 | Evans et al. | ..... | 473/324 |
| 6,773,360 | B2 * | 8/2004 | Willett et al. | ..... | 473/334 |
| 6,974,393 | B2 * | 12/2005 | Caldwell et al. | ..... | 473/324 |
| 7,108,609 | B2 * | 9/2006 | Stites et al. | ..... | 473/256 |
| 7,189,169 | B2 * | 3/2007 | Billings | ..... | 473/332 |
| 7,198,575 | B2 * | 4/2007 | Beach et al. | ..... | 473/324 |
| 7,344,452 | B2 * | 3/2008 | Imamoto et al. | ..... | 473/345 |

(Continued)

*Primary Examiner* — Sebastiano Passaniti
(74) *Attorney, Agent, or Firm* — Rebecca Hanovice; Michael A. Catania; Sonia Lari

(57) ABSTRACT

A golf club head having a face component, a crown, and a composite sole with one or more weight ports for receiving one or more weight inserts is disclosed herein. At least part of each of the weight ports is integrally formed in the composite sole, and each of the weight ports include a weight receiving region for receiving a weight and a screw receiving region for receiving a screw that secures the weight in the weight port.

20 Claims, 3 Drawing Sheets

U.S. PATENT DOCUMENTS

| | | | | |
|---|---|---|---|---|
| 7,377,860 | B2 * | 5/2008 | Breier et al. | 473/334 |
| 7,407,447 | B2 * | 8/2008 | Beach et al. | 473/324 |
| 7,462,110 | B2 * | 12/2008 | Yamamoto | 473/334 |
| 7,628,711 | B2 * | 12/2009 | Akinori et al. | 473/335 |
| 7,871,339 | B2 * | 1/2011 | Sanchez et al. | 473/335 |
| 8,020,606 | B2 * | 9/2011 | Chao et al. | 164/516 |
| 8,033,930 | B2 * | 10/2011 | Tavares et al. | 473/339 |
| 8,062,151 | B2 * | 11/2011 | Boyd et al. | 473/334 |
| 8,092,316 | B2 * | 1/2012 | Breier et al. | 473/244 |
| 2005/0043115 | A1 * | 2/2005 | Lin | 473/345 |
| 2006/0058112 | A1 * | 3/2006 | Haralason et al. | 473/334 |
| 2006/0105856 | A1 * | 5/2006 | Lo | 473/334 |
| 2006/0217216 | A1 * | 9/2006 | Iizuka | 473/349 |
| 2008/0039228 | A1 * | 2/2008 | Breier et al. | 473/334 |
| 2010/0311520 | A1 * | 12/2010 | Bezilla et al. | 473/335 |

* cited by examiner

GOLF CLUB HEAD WITH COMPOSITE WEIGHT PORT

CROSS REFERENCES TO RELATED APPLICATIONS

The present application is a continuation of U.S. patent application Ser. No. 13/364,089, filed on Feb. 1, 2012, which is a continuation of U.S. patent application Ser. No. 13/248,855, filed on Sep. 29, 2011, which claims priority to U.S. Provisional Application No. 61/388,124, filed on Sep. 30, 2010, and which is a continuation-in-part of U.S. patent application Ser. No. 12/940,371, filed on Nov. 5, 2010, which claims priority to U.S. Provisional Application No. 61/286,971, filed on Dec. 16, 2009, each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a composite sole with one or more weight ports to house one or more removable weights. More specifically, the present invention relates to a golf club head having a composite sole with integrally formed weight ports and a removable, metal weight insert.

2. Description of the Related Art

As driver golf club heads have increased in volume to greater than 300 cubic centimeters, their moments of inertia have also increased, providing greater forgiveness for off-center hits. The conventional method for enlargement of golf club heads was to maximize the spatial distribution of mass in all three orthogonal orientations. Although this approach was effective in increasing the moments of inertia of the golf club heads, it also resulted in the center of gravity of the golf club head being positioned substantially rearward from the front face of the golf club head.

As the center of gravity is positioned further rearward from the front face, deleterious effects result for shots struck off-center from the sweet spot of the golf club head. Increased gear effect is the main cause of the deleterious effects. For heel-ward or toe-ward off-center hits, the increased gear effect can cause increased side-spin, which increases dispersion, reduces distance and reduces robustness of ball flight. For off-center hits above the sweet spot, the increased gear effect causes reduced backspin, which can cause an undesirable trajectory having insufficient carry length or time of flight, which in turn can result in reduced distance and reduced robustness.

In addition, the same conventional golf club head designs are limited with regard to the maximum face area, both physical and practical limitations. The physical limitation is due to the golf club head having insufficient mass to both increase the length and width of the golf club head and also to increase the face size without exceeding the upper range of the preferred total golf club head mass. Such mass distributions are dependent on minimum wall thickness values required to achieve acceptable in-service durability.

The practical limitation is that as the face size is increased, hit locations in certain regions around the face perimeter will yield an unsatisfactory ball flight due to the above-mentioned deleterious effects, which are accentuated for larger faces.

The deleterious effects increase in a non-linear manner as the distance from the face center increases. Thus the incremental face area gained by increasing face size will be subject to more extreme deleterious effects. This limits the practical length of the club, because probable hit distribution across the surface of the face broadens as the club length increases. As a result a longer club will yield a larger percentage of hits in the perimeter regions of the face where the deleterious effects occur. This offsets the otherwise beneficial effect of increased head speed. As club length increases, head speed increases up to a length of approximately 52 inches, at which point aerodynamic and biomechanical effects offset the length effect.

Further, conventional head designs having a center of gravity positioned substantially rearward from the face are subject to significant dynamic loft effects, which can be undesirable. Dynamic loft increases with head speed, so that golfers with higher head speeds experience more dynamic loft than those with slower swing speeds. This is opposite of what is desired as higher head speeds generally require less loft, otherwise excess backspin will be generated, which negatively affects trajectory and performance.

Currently, golf club heads made of metal, composite, or other material are produced with a specific weight which is fixed once the golf club head is finished. The fixed weight of the golf club head determines the center of gravity and moment of inertia. After the golf club head is finished, there exists a small amount of weight which needs to be adjusted. This small amount of weight is called the swing weight. Presently, if the swing weight needs to be adjusted, to alter the center of gravity and/or moment of inertia, the fixed weight must be changed, which requires the manufacture of a new golf club head.

One invention that addresses a golf club head with an improved moment of inertia and center of gravity is U.S. Pat. No. 7,559,851 issued to Cackett et al. for Golf Club Head with High Moment of Inertia. This patent discloses a golf club head with a moment of inertia, Izz, about the center of gravity of the golf club head that exceeds 5000 grams-centimeters squared.

Another example is U.S. Pat. No. 3,897,066 to Belmont which discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

Yet another example is U.S. Pat. No. 2,750,194 to Clark which discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

Although the prior art has disclosed many variations of golf club heads with weight adjustment means, the prior art has failed to provide a club head with both a superior material construction and a high-performance weighting configuration.

BRIEF SUMMARY OF THE INVENTION

It is the object of this invention to adjust the swing weight of the golf club head externally, without having to manufacture or purchase a new golf club head. A golfer using the present invention will be able to adjust the center of gravity and moment of inertia to best suit his or her playing needs. The golf club head has external weights positioned at specific locations on the golf club head body to improve the center of gravity and moment of inertia characteristics. The weights to be inserted into the cavities of the golf club head all may be of the same size and shape, however will vary in density. This allows for the weights to be interchangeable depending on the golfer's individual needs. The aft-body of the golf club head is preferably composed of a composite material with recessed cavities to engage the weights.

One aspect of the invention is a golf club head comprising a face component, a crown, and a composite sole having exterior and interior surfaces, wherein the composite sole includes at least one weight port. In another embodiment of the invention, the weight port comprises a composite component and a metal component. In yet a further embodiment of the invention, the metal component is affixed to the interior surface of the composite sole. In a further embodiment of the invention, the golf club head comprises a weight insert, wherein the weight insert is affixed to the weight port with a screw. In yet another embodiment of the invention, the weight insert is composed of a metal material. In an alternative embodiment of the invention, the screw is composed of a metal material. In a further embodiment of the present invention, the weight port has a conical shape and the weight insert has a shape that fits within the weight port. In a further embodiment of the present invention, the weight insert has a conical shape.

Another aspect of the present invention is a golf club head comprising a metal face component, a crown, a composite sole, and a metal weight insert having a conical shape, wherein the composite sole has at least one, integrally formed weight port, wherein the weight port is conical in shape, wherein the weight port has a metal screw receiving component, and wherein the weight insert is affixed to the weight port with a metal screw. In another embodiment, the metal screw receiving component is threaded. In yet another embodiment, the metal screw attaches to the metal screw receiving component and thereby secures the weight insert in the weight port. In a further embodiment, the face component is composed of titanium. In another embodiment, the crown is composed of titanium. In yet another embodiment, the crown is composed of composite material. In another embodiment, the sole has at least three integrally formed weight ports and at least three metal weight inserts. In another embodiment, the golf club is a driver. In yet another embodiment, the golf club is a fairway wood.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
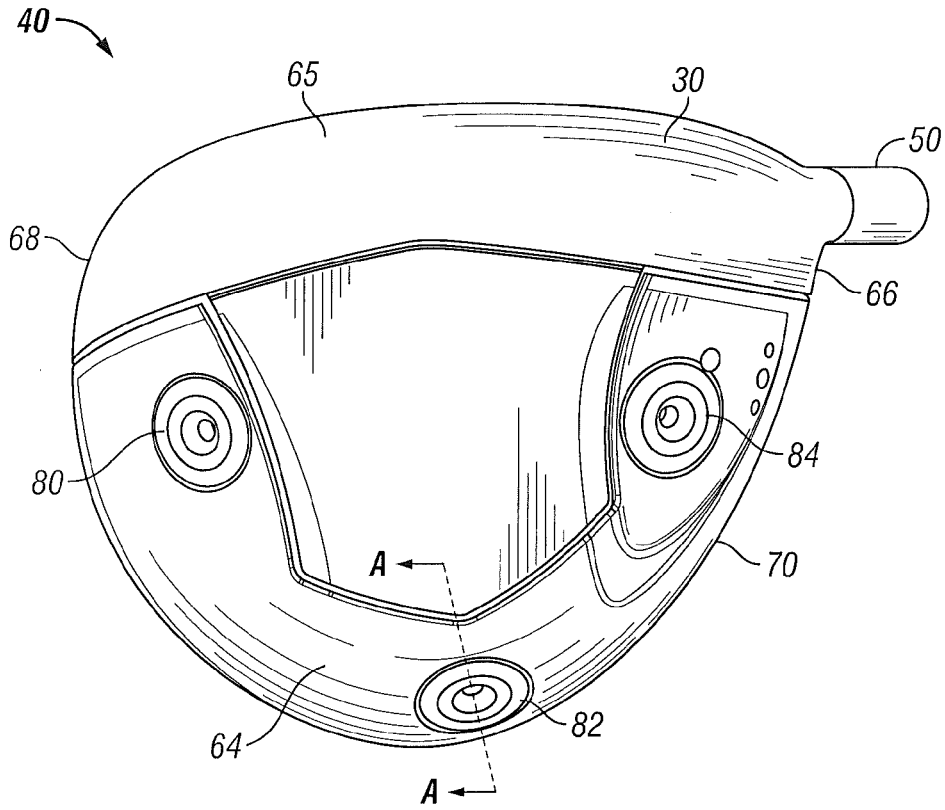
FIG. 1 is sole-side view of a golf club head according to an embodiment of the present invention.
Figure 2:
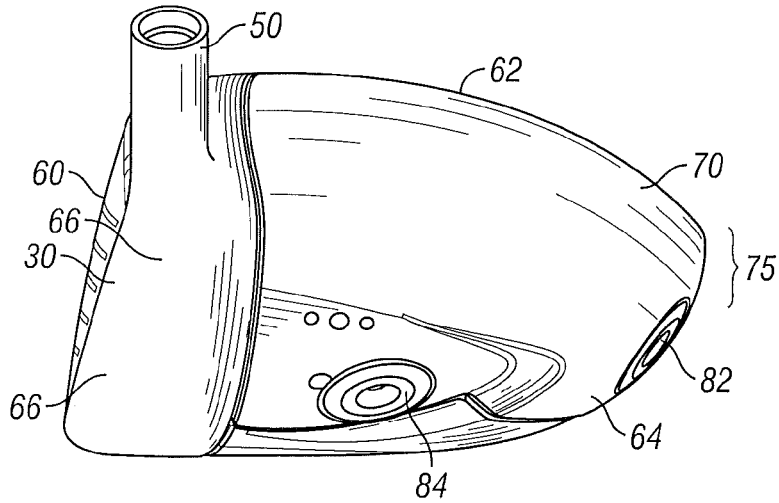
FIG. 2 is a heel-side view of the golf club head shown in FIG. 1.
Figure 3:
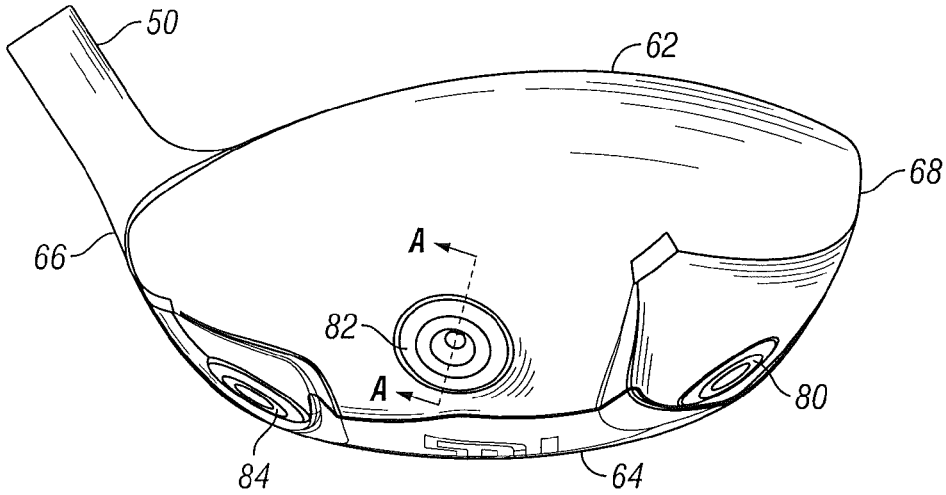
FIG. 3 is a rear view of the golf club head shown in FIG. 1.

The present invention is generally directed to a golf club head with one or more weight ports that are formed in a composite sole and house removable weight inserts. In some embodiments, the one or more weight ports are integrally formed in the sole.

Views of the preferred embodiment of the present invention are shown in FIGS. 1-5. The golf club head 40 shown in FIGS. 1-3 has a hollow interior 90, shown in FIG. 5, and is generally composed of a face component 30 comprising a face 60, a face extension 65, and a hosel 50, and an aft body 70 comprising a crown 62 and a sole 64 having three weight ports 80, 82, 84. In alternative embodiments, the golf club head 40 may have one, two, or more than three weight ports. The club head 40 also may optionally have a ribbon, skirt, or side portion (not shown) disposed between the crown 62 and sole 64 portions. The golf club head 40 is preferably partitioned into a heel section 66 nearest the hosel 50, a toe section 68 opposite the heel section 66, and a rear section 75 opposite the face component 60. The preferred embodiment of the golf club head 40 shown in FIGS. 1-5 has a volume of approximately 460 cubic centimeters and a face 60 with a characteristic time that is close to, but does not exceed, 257 μs.

In the preferred embodiment shown in FIGS. 1-5, the face component 30 is made of titanium and the aft body 70 (including the crown 62 and sole 64) is made of a composite material. The composite crown 62 and sole 64 may be formed using one or more of the techniques described in U.S. Patent Publication Nos. 20100139079 and 20110065528, and U.S. patent application Ser. No. 12/886,773, the disclosures of which are hereby incorporated by reference in their entireties herein.

Figure 4:
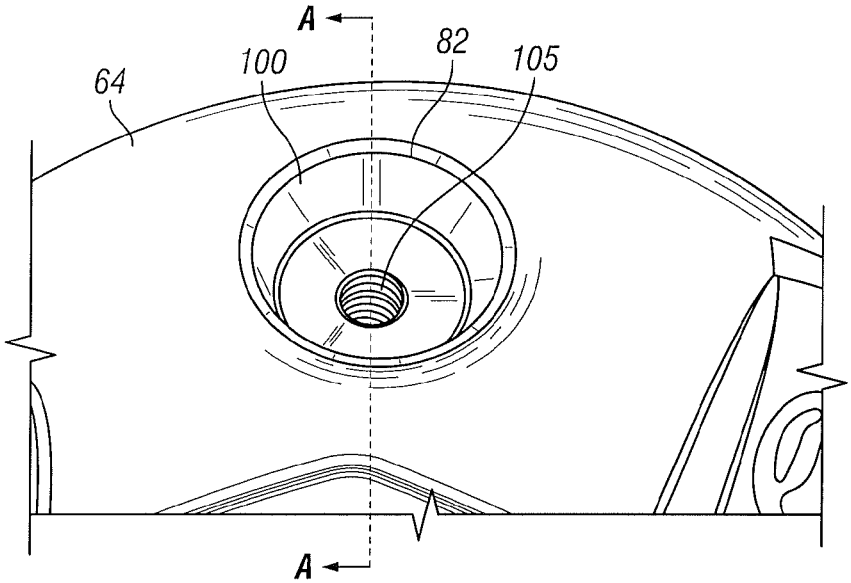
FIG. 4 is a top view of a weight port shown in FIG. 1.
Figure 5:
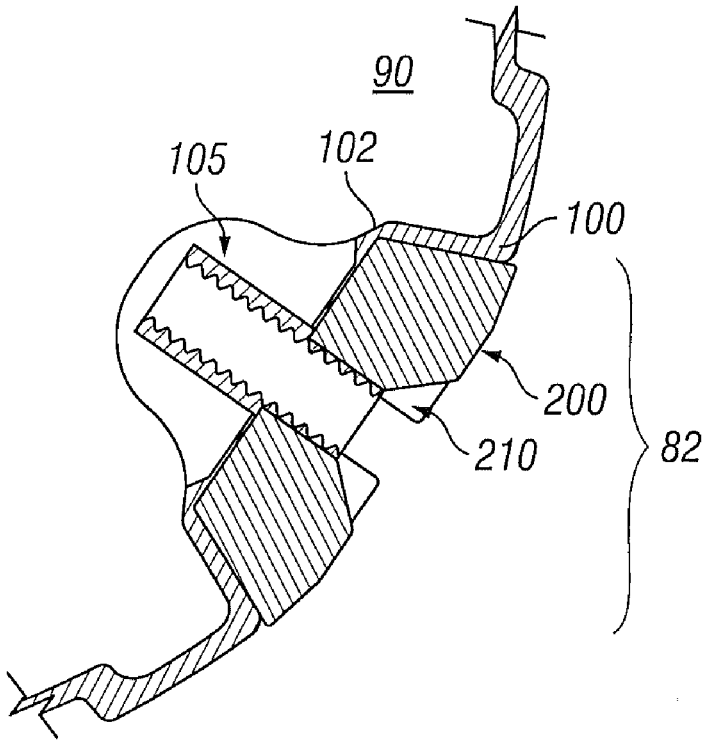
FIG. 5 is a cross-sectional view of the weight port and golf club head shown in FIG. 4 along line A-A.

At least part of each weight port 80, 82, 84 is integrally formed in the composite sole 64. As shown in FIGS. 4 and 5, the weight port 82 comprises a weight receiving region 100 and a screw receiving region 105. In the preferred embodiment, the weight receiving region 100 is the portion of the weight port 82 that is integrally formed in the composite and the screw receiving region 105 is a separate metal piece that is affixed to the interior surface 102 of the composite weight receiving region 100. The screw receiving region 105 may be affixed to the interior surface 102 of the composite weight receiving component 100 with an adhesive or with a screw, and in the preferred embodiment the screw receiving region 105 has threads. Other techniques of affixing the screw receiving region 105 to the composite weight receiving region 100 may be utilized. In alternative embodiments, the screw receiving region 105 may be composed of a material other than metal, such as composite or plastic.

As shown in FIG. 5, a weight 200 is placed into the weight port 82 and received by the composite weight receiving region 100. The weight 200 is secured within the weight port 82 with a screw 210. The weight 200 may be removed from the weight port 82 by unscrewing the screw 210 and removing both the screw 210 and the weight 200 from the weight port 82.

Figure 6:
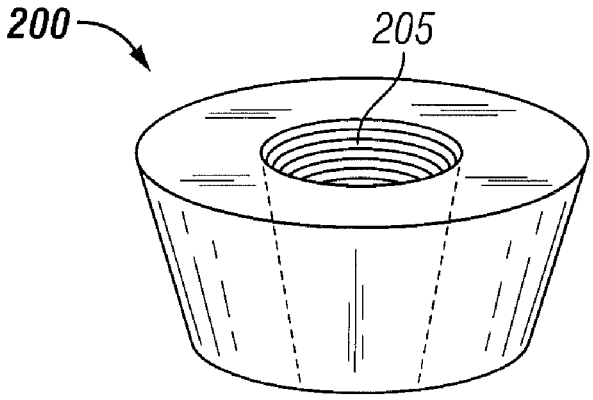
FIG. 6 is a side perspective view of a weight insert that can be used with the golf club head shown in FIG. 1.

In the preferred embodiment, the weight ports 80, 82, 84 are shaped to receive a conical weight. Also in the preferred embodiment, the weight 200 is conical in shape with a central aperture 205 for receiving a screw 210, as shown in FIG. 6, and both the weight 200 and the screw 210 are composed of a metal material. The weight 200 and screw 210 may, in alternative embodiments, be composed of other materials, such as composite or plastic. In some embodiments, the weight 200 and/or screw 210 may be made of stainless steel, titanium, tungsten, or other metal materials.

The weight 200 preferably ranges in mass between 1 grams and 40 grams, more preferably between 10 grams and 30 grams, and most preferably 15 grams to 25 grams. More specifically, if the weight 200 is chosen for insertion in the toe-section 68 weight port 80, the weight 200 preferably ranges in mass between 5 grams and 25 grams, more preferably between 6 grams and 20 grams, and most preferably 6 grams to 16 grams. More specifically, if the weight 200 is chosen for insertion in the heel section 66 weight port 84, the heel weight 200 preferably ranges in mass between 10 grams and 40 grams, more preferably between 10 grams and 30 grams, and most preferably 12 grams to 29 grams. More specifically, if the weight 200 is chosen for insertion in the rear section 75 weight port 82, the weight 200 preferably ranges in mass between 10 grams and 40 grams, more preferably between 15 grams and 30 grams, and most preferably 23 grams.

In other embodiments, the face component 30 and crown 62 may be made from cast or forged metals or from composite materials, and may be formed integrally or pieced together. In yet other embodiments, the face component 30 and crown 62 each may be composed of different materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

Another aspect of the golf club head 40 of the present invention is directed a golf club head 40 that has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 40 preferably has a coefficient of restitution ranging from 0.80 to 0.94, as measured under conventional test conditions.

The coefficient of restitution of the club head 40 of the present invention under standard USGA test conditions with a given ball preferably ranges from approximately 0.80 to 0.94, more preferably ranges from 0.82 to 0.89 and is most preferably 0.86.

As defined in *Golf Club Design, Fitting, Alteration & Repair,* $4^{th}$ Edition, by Ralph Maltby, the center of gravity, or center of mass, of the golf club head 40 is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 40 are preferably measured using a test frame ($X^T$, $Y^T$, $Z^T$), and then transformed to a head frame ($X^H$, $Y^H$, $Z^H$). The center of gravity of a golf club head 40 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head 40, the scales allow one to determine the weight distribution of the golf club head when the golf club head 40 is placed on both scales simultaneously and weighed along a particular direction, the X, Y or Z direction.

In general, the moment of inertia, Izz, about the Z axis for the golf club head 40 of the present invention is preferably greater than 3000 g-cm$^2$, and more preferably greater than 3500 g-cm$^2$. The moment of inertia, Iyy, about the Y axis for the golf club head 40 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 40 of the present invention is preferably in the range from 1500 g-cm$^2$ to 3800 g-cm$^2$, more preferably from 1600 g-cm$^2$ to 3100 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face plate;

a crown;

a composite sole comprising an interior surface, an exterior surface, and at least one integrally formed weight port;

at least one metal screw-receiving component comprising a first bore; and at least one removable weight sized to fit within and make direct contact with the at least one integrally formed weight port, wherein the first bore comprises threads, wherein the golf club head has a volume of at least 120 and no more than 600 cubic centimeters, wherein the weight port comprises a first diameter and a second bore having a second diameter, wherein the first diameter is greater than the second diameter, and wherein the screw-receiving component is affixed to the weight port with an adhesive such that the first bore aligns with the second bore.

2. The golf club head of claim 1, wherein the sole comprises a heel section and a toe section, and wherein the at least one integrally formed weight port is disposed in the toe section.

3. The golf club head of claim 2, wherein the sole further comprises a second, integrally formed weight port, and wherein the second weight port is located in the heel section.

4. The golf club head of claim 1, wherein the screw-receiving component is affixed to the interior surface of the sole.

5. The golf club head of claim 1, wherein the screw-receiving component is affixed to the exterior surface of the sole.

6. The golf club head of claim 1, wherein the weight is affixed to the weight port with a metal screw.

7. The golf club head of claim 1, wherein the weight is composed of a metal material and has a weight of no less than 2 grams and no more than 20 grams.

8. The golf club head of claim 1, wherein the weight is composed of both metal and non-metal materials.

9. The golf club head of claim 1, wherein the crown is composed of a composite material.

10. The golf club head of claim 9, wherein the crown comprises at least one integrally formed weight port.

11. The golf club head of claim 9, wherein the crown and sole are integrally formed.

12. A golf club head comprising:

a face plate composed of a titanium alloy;

a crown comprising a first integrally formed weight port;

a composite sole comprising a second integrally formed weight port and a third integrally formed weight port;

a first metal screw-receiving component comprising a first bore;

a second metal screw-receiving component comprising a second bore; and a plurality of removable weights sized to fit within and make direct contact with at least one of the integrally formed weight ports, wherein each of the first and second bores comprises threads, wherein the golf club head has a volume of at least 120 cubic centimeters and no more than 600 cubic centimeters, wherein each of the second and third integrally formed weight ports comprises a first diameter and an unthreaded bore having a second diameter, wherein the first diameter is greater than the second diameter, wherein the first screw-receiving component is affixed to the second integrally formed weight port with an adhesive such that the first bore aligns with the unthreaded bore, and wherein the second screw-receiving component is affixed to the third integrally formed weight port with an adhesive such that the second bore aligns with the unthreaded bore.

13. The golf club head of claim 12, wherein the crown is composed of a metal material.

14. A driver-type golf club head comprising:

a metal face plate;

a composite aft body comprising a crown, a ribbon, and a sole;

at least two metal screw-receiving components, each of which comprises a threaded bore; and at least one removable metal weight, wherein the aft body comprises at least two, integrally formed weight ports;

wherein each of the integrally formed weight ports comprises a first diameter and an unthreaded bore comprising a second diameter, wherein the first diameter is greater than the second diameter, wherein each of the at least two metal screw-receiving components is affixed to one of the integrally formed weight ports such that the threaded bore aligns with the unthreaded bore, wherein the at least one weight is affixed within one of the at least two weight ports such that the at least one weight makes direct contact with the weight port, and wherein the driver-type golf club head has a volume of no less than 440 cubic centimeters and no more than 470 cubic centimeters.

15. The driver-type golf club head of claim 14, wherein the face plate is composed of a titanium alloy.

16. The driver-type golf club head of claim 14, wherein the aft body is integrally formed.

17. The driver-type golf club head of claim 14, wherein the at least two integrally formed weight ports are located in the sole.

18. The driver-type golf club head of claim 14, wherein at least one integrally formed weight port is located in each of the crown, the sole, and the ribbon.

19. The driver-type golf club head of claim 14, wherein the sole comprises at least two integrally formed weight ports and wherein the crown comprises at least one integrally formed weight port.

20. The driver-type golf club head of claim 14, wherein the at least one weight is composed of a material selected from the group consisting of tungsten alloy, stainless steel, and titanium alloy.

* * * * *